US009598935B2

(12) United States Patent
Hay

(10) Patent No.: US 9,598,935 B2
(45) Date of Patent: Mar. 21, 2017

(54) FLUID CONTAINER RELOADING TOOL

(71) Applicant: Halliburton Energy Services, Inc., Houston, TX (US)

(72) Inventor: Richard Thomas Hay, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 154 days.

(21) Appl. No.: 14/568,804

(22) Filed: Dec. 12, 2014

(65) Prior Publication Data

US 2015/0096765 A1 Apr. 9, 2015

Related U.S. Application Data

(63) Continuation of application No. 14/360,235, filed as application No. PCT/US2012/041839 on Jun. 11, 2012, now Pat. No. 8,910,711.

(51) Int. Cl.

| | |
|---|---|
| ***E21B 49/08*** | (2006.01) |
| ***E21B 47/00*** | (2012.01) |
| ***E21B 41/00*** | (2006.01) |
| ***E21B 27/00*** | (2006.01) |
| ***E21B 23/01*** | (2006.01) |

(Continued)

(52) U.S. Cl.

CPC ..... *E21B 41/00* (2013.01); *E21B 23/01* (2013.01); *E21B 23/08* (2013.01); *E21B 27/00* (2013.01); *E21B 47/06* (2013.01); *E21B 49/082* (2013.01); *E21B 49/083* (2013.01)

(58) Field of Classification Search

CPC ..... E21B 49/081; E21B 10/18; E21B 21/08; E21B 27/00; E21B 49/10; E21B 49/08; E21B 47/011

See application file for complete search history.

(56) References Cited

U.S. PATENT DOCUMENTS 3,530,710 A 9/1970 Beloglazov et al.
4,955,438 A * 9/1990 Juergens ..... E21B 25/02 166/64

(Continued)

FOREIGN PATENT DOCUMENTS

WO 00/66878 A1 11/2000
WO 2010/039043 A1 4/2010

OTHER PUBLICATIONS

International Search Report and Written Opinion issued in PCT Application No. PCT/US2012/041839, mailed Mar. 8, 2013 (10 pages).

(Continued)

*Primary Examiner* — Zakiya W Bates
(74) *Attorney, Agent, or Firm* — Alan Bryson; Baker Botts L.L.P.

(57) ABSTRACT

A fluid container reloading tool for a downhole fluid sampling tool is described. The reloading tool includes an elongated cylindrical body. The body may include a bottom opening sized to engage with a fluid sampling tool deployed within a borehole. A cache of empty fluid containers may be included within the body. A piston may be coupled to at least one of the fluid containers in the cache of fluid containers. The piston may be used to transfer the cache of fluid containers into the fluid sampling tool. The reloading tool may also include a pump in fluid communication with the piston.

9 Claims, 9 Drawing Sheets

(51) Int. Cl.
*E21B 23/08* (2006.01)
*E21B 47/06* (2012.01)

(56) References Cited

U.S. PATENT DOCUMENTS

| | | | | |
|---|---|---|---|---|
| 5,526,887 | A | 6/1996 | Vestavik | |
| 7,062,958 | B2 | 6/2006 | Diankonov et al. | |
| 7,260,985 | B2 | 8/2007 | Gilbert et al. | |
| 7,546,885 | B2 | 6/2009 | Longfield | |
| 2010/0314106 | A1* | 12/2010 | Tubel | E21B 17/20 166/250.1 |
| 2011/0120238 | A1 | 5/2011 | Lee et al. | |
| 2011/0240285 | A1 | 10/2011 | Vestavik | |

OTHER PUBLICATIONS

International Preliminary Report on Patentability issued in PCT Application No. PCT/US2012/041839, mailed Dec. 24, 2014 (6 pages).

* cited by examiner

FLUID CONTAINER RELOADING TOOL

CROSS-REFERENCE TO RELATED APPLICATIONS

This application is a continuation of U.S. National Stage application Ser. No. 14/360,235, which was filed on May 22, 2014, and claims the benefit of International Application No. PCT/US2012/041839, which was filed Jun. 11, 2012, both of which are hereby incorporated by reference in their entirety.

BACKGROUND

The present disclosure relates generally to well drilling operations and, more particularly, to fluid sampling during well drilling operations.

Existing well drilling operations require information on formation characteristics to aid in drilling decisions. Numerous measurement techniques are used, including logging while drilling (LWD), measuring while drilling (MWD), and wireline tests. One such measurement technique requires that a sample of various downhole fluids is taken. These downhole fluids may include, for example, formation fluids, or fluids captured within the formations that are drawn out into a borehole. Typical systems capture the fluids downhole and store the sample in a container integrated within the sampling tool itself, such that the entire tool must be retrieved to the surface before the sample can be accessed. What is needed is a fluid sampling tool with retrievable and reloadable fluid samples, and a way to capture the fluid samples at the surface.

FIGURES

Some specific exemplary embodiments of the disclosure may be understood by referring, in part, to the following description and the accompanying drawings.

FIG. 1 illustrates an example drilling system, according to aspects the present disclosure.

FIGS. 2*a-d* illustrate a vertical cross-section of an example fluid sampling tool, according to aspects of the present disclosure.

Figure 5A:
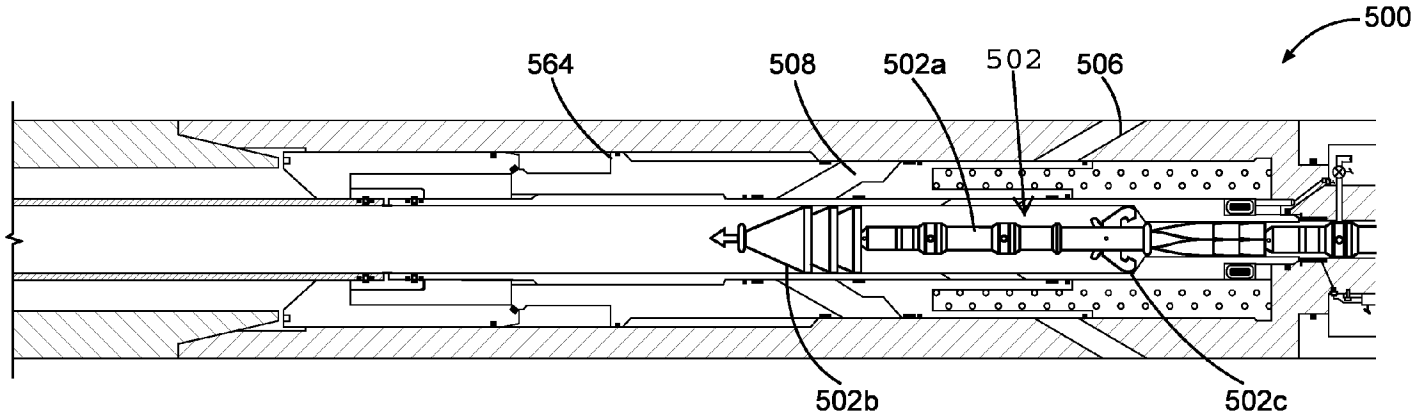
Figure 5B:
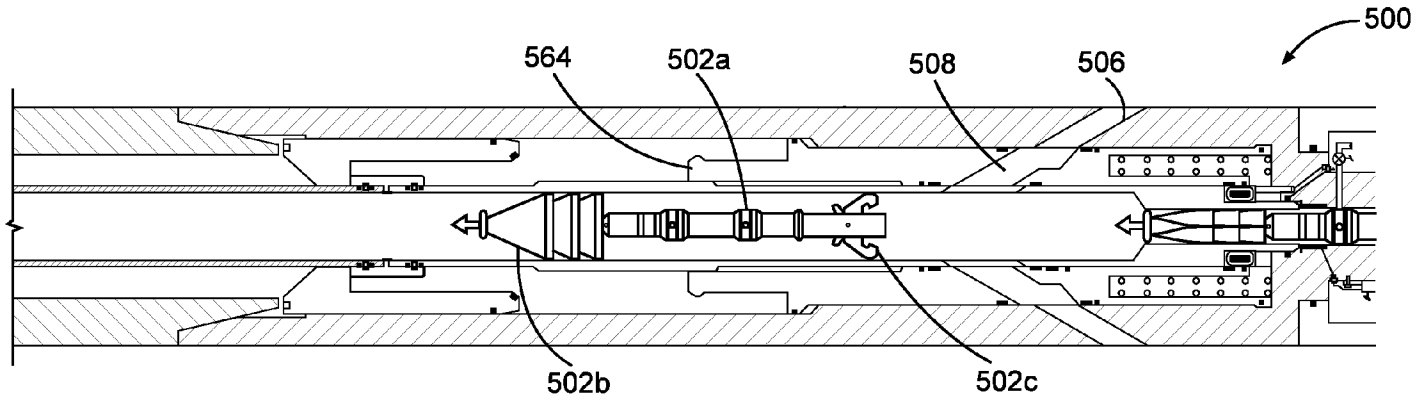

FIGS. 5*a* and 5*b* illustrate an example process for deploying fluid samples, according to aspects of the present disclosure.

Figure 6:
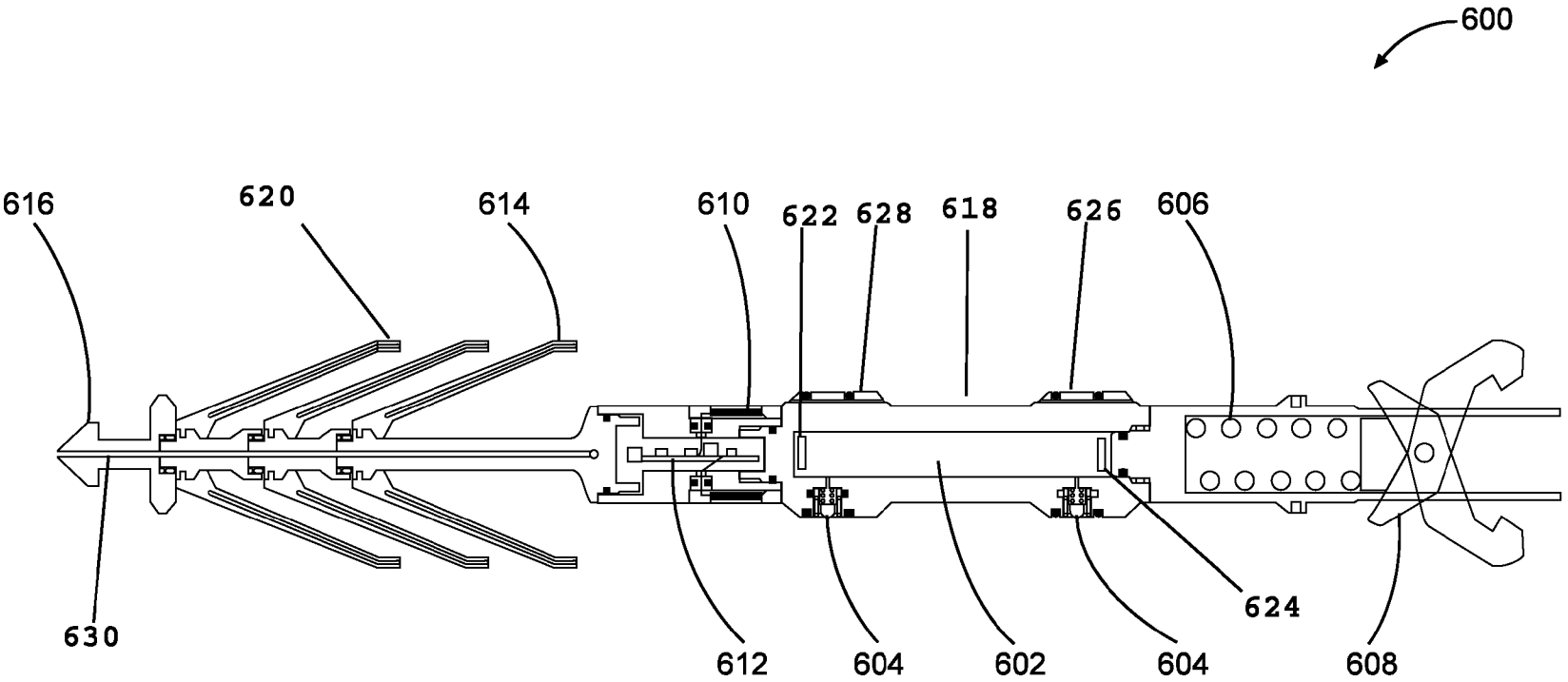

FIG. 6 illustrates an example fluid container, according to aspects of the present disclosure.

Figure 7A:
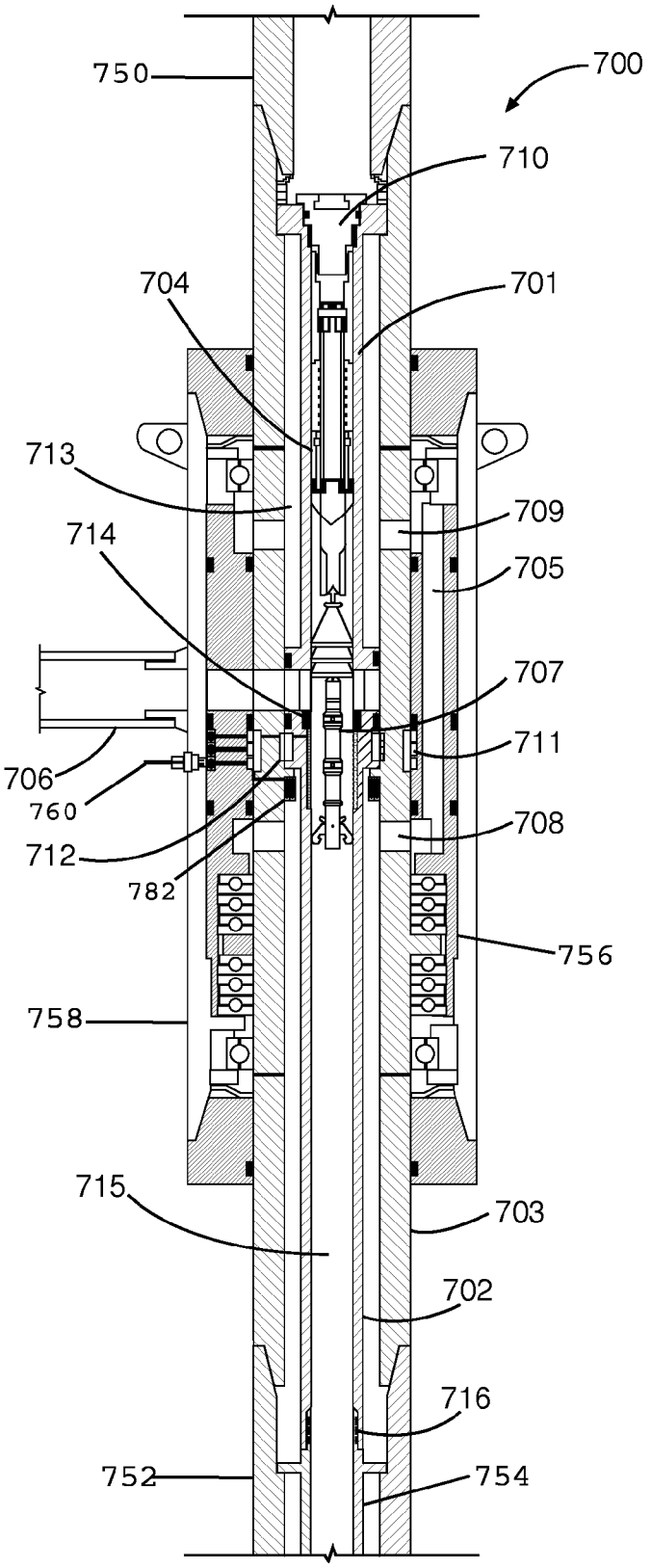
Figure 7B:
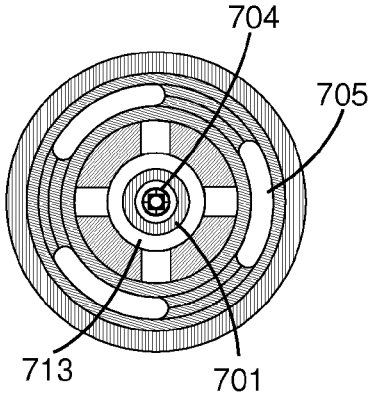
Figure 7C:
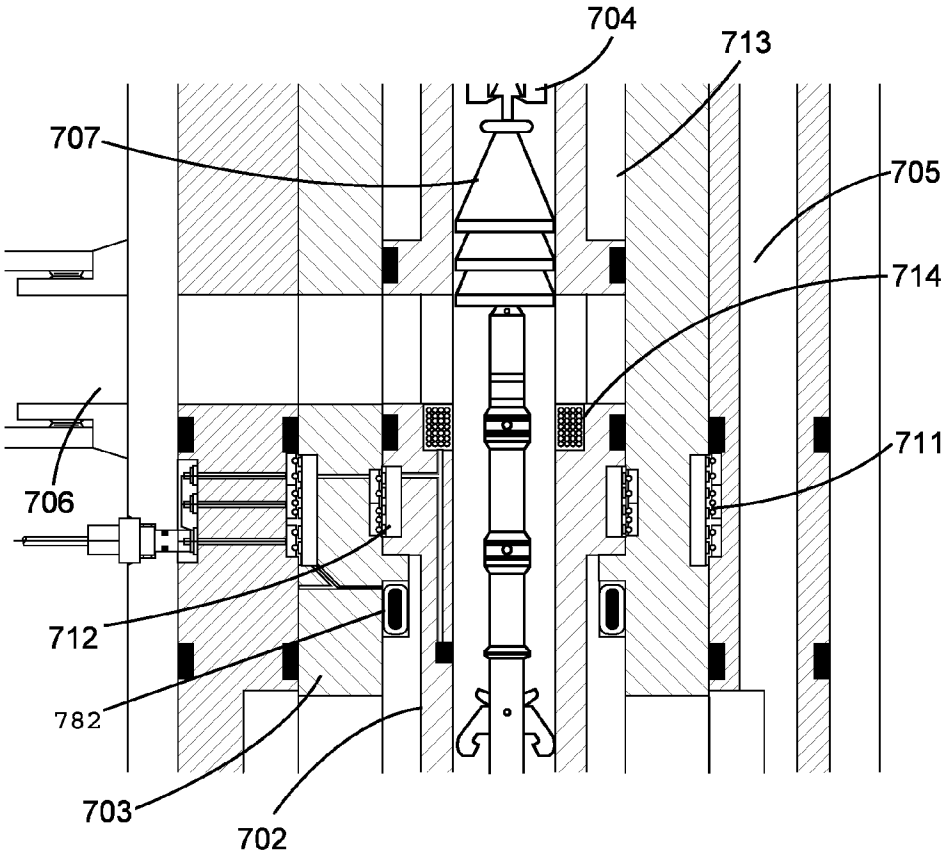

FIGS. 7*a-c* illustrate an example fluid sample capture tool, according to aspects of the present disclosure.

Figure 8:
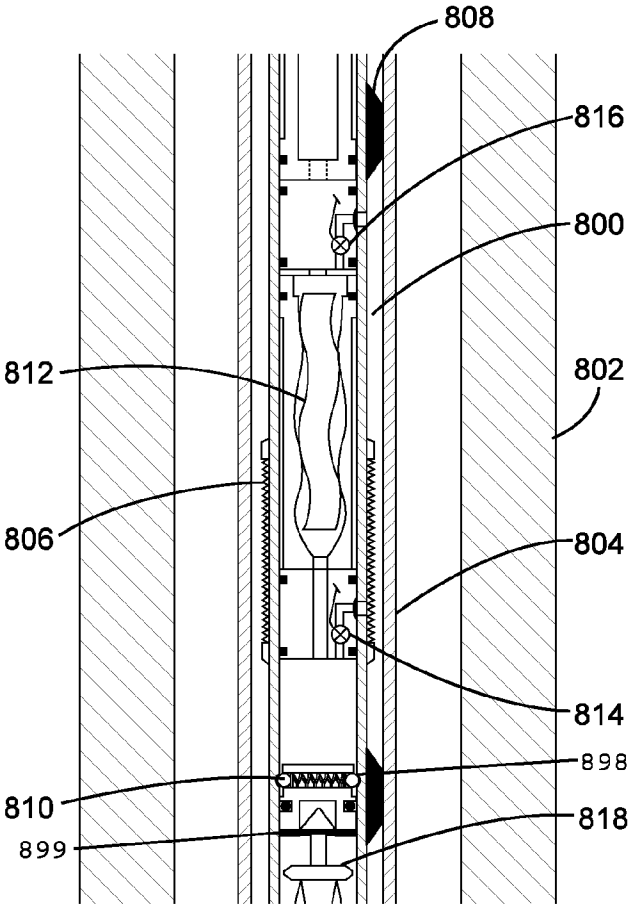

FIG. 8 illustrates a portion of example reloader tool, according to aspects of the present disclosure.

Figure 9A:
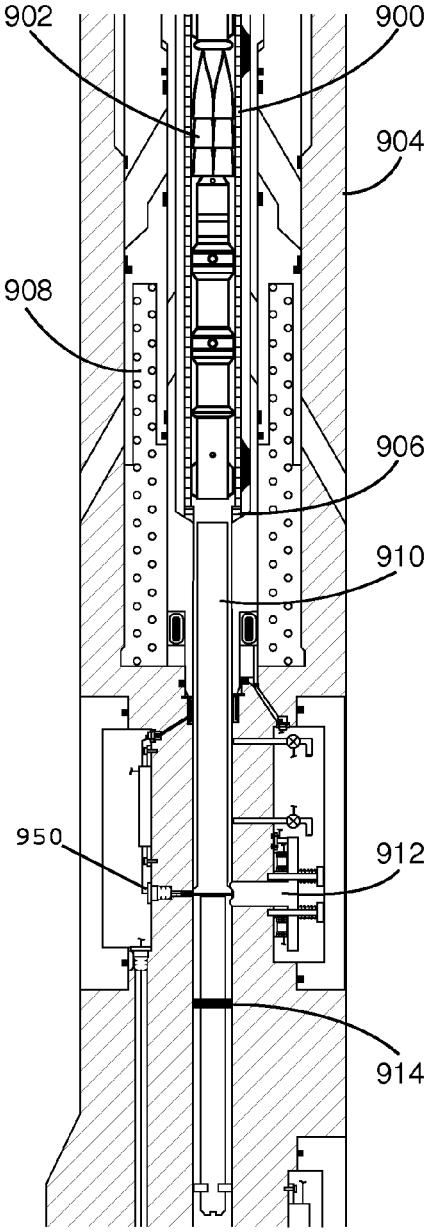
Figure 9B:
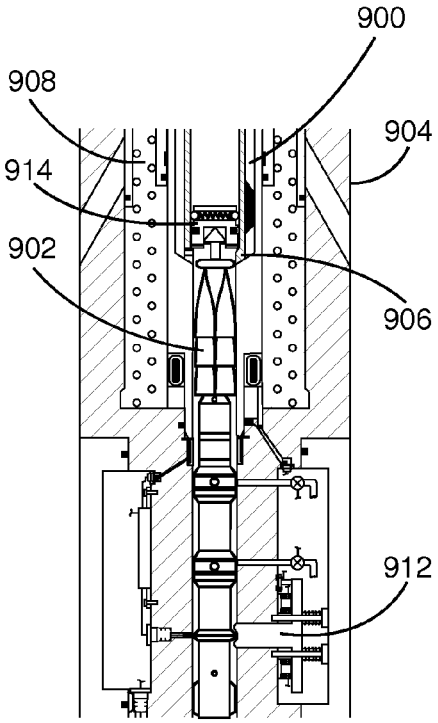

FIGS. 9*a* and 9*b* illustrate an example reloader tool reloading a cache of fluid containers in an example fluid sampling tool.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to well drilling operations and, more particularly, to fluid sampling during well drilling operations.

Illustrative embodiments of the present disclosure are described in detail herein. In the interest of clarity, not all features of an actual implementation may be described in this specification. It will of course be appreciated that in the development of any such actual embodiment, numerous implementation-specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present disclosure, the following examples of certain embodiments are given. In no way should the following examples be read to limit, or define, the scope of the disclosure. Embodiments of the present disclosure may be applicable to horizontal, vertical, deviated, multilateral, u-tube connection, intersection, bypass (drill around a mid-depth stuck fish and back into the well below), or otherwise nonlinear wellbores in any type of subterranean formation. Embodiments may be applicable to injection wells as well as production wells, including natural resource production wells such as hydrogen sulfide, hydrocarbons or geothermal wells. Devices and methods in accordance with embodiments described herein may be used in one or more of wireline, slickline, MWD and LWD operations. Embodiments described below with respect to one implementation, such as wireline, are not intended to be limiting. Embodiments may be implemented in various formation tester tools suitable for testing, retrieval and sampling along sections of the formation that, for example, may be conveyed through flow passage in tubular string or using a wireline, slickline, tractor, piston, piston-tractor, coiled tubing, downhole robot or the like.

Figure 1:
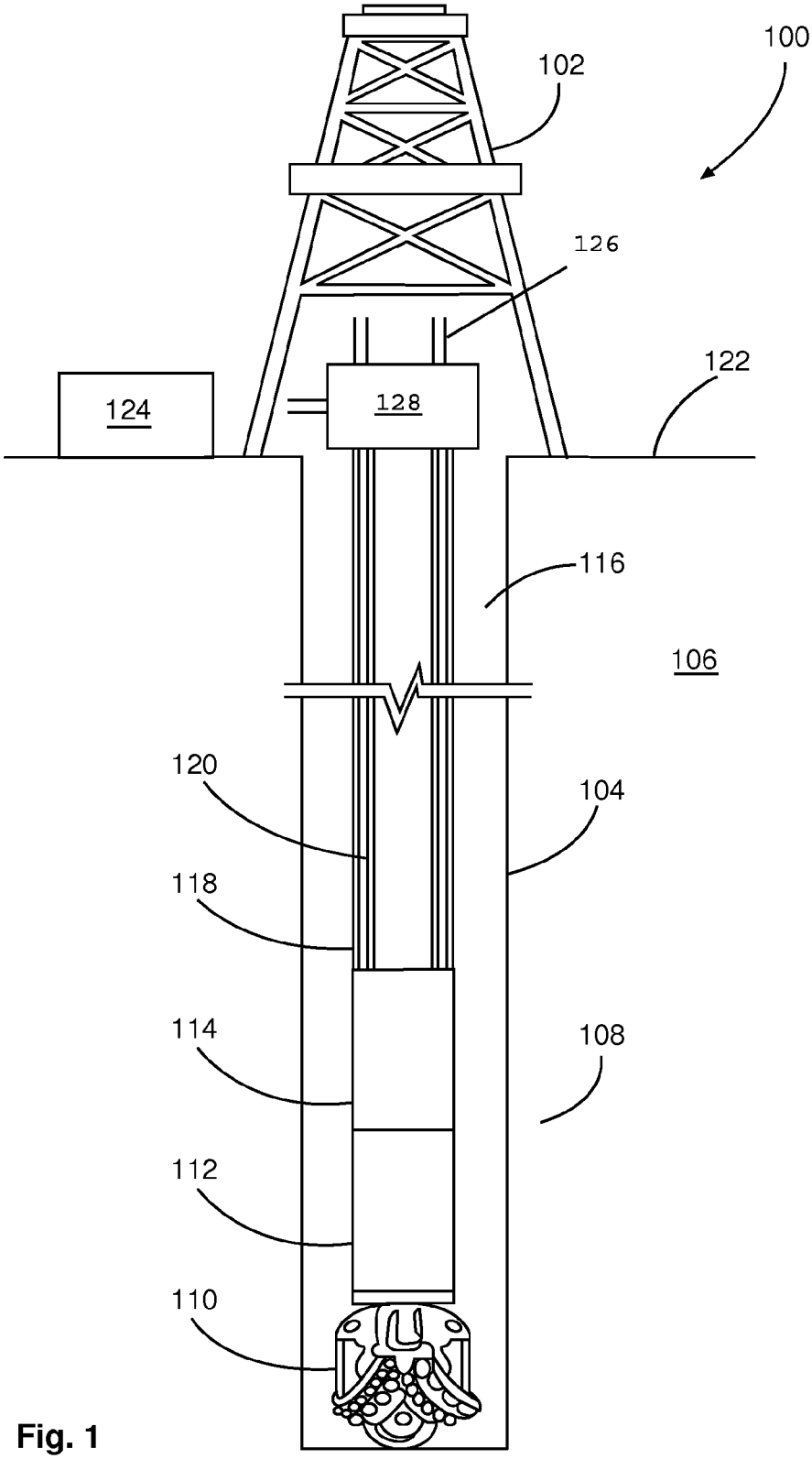
Figure 2A:
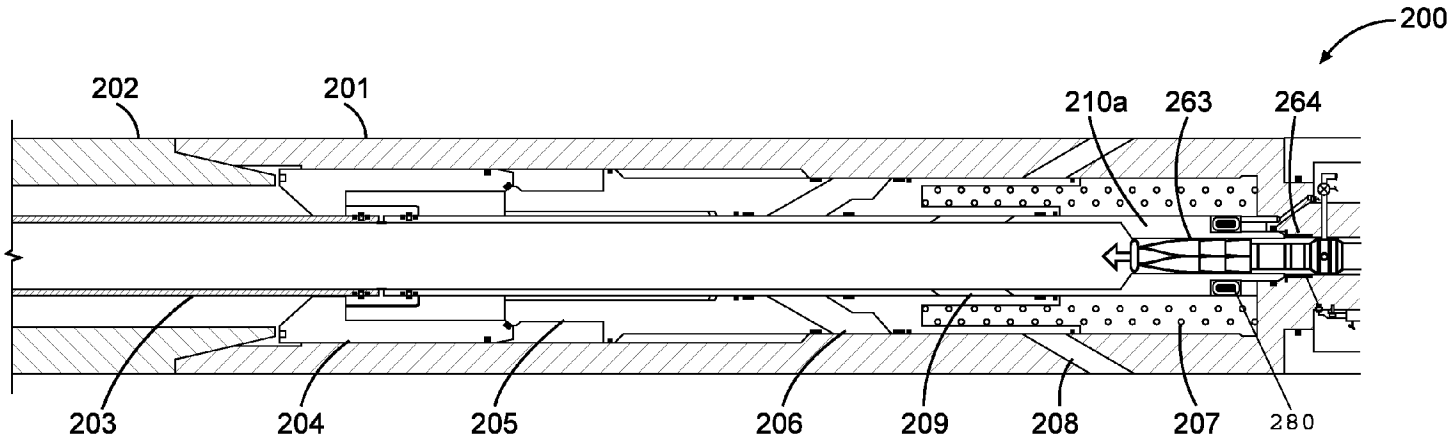
Figure 2B:
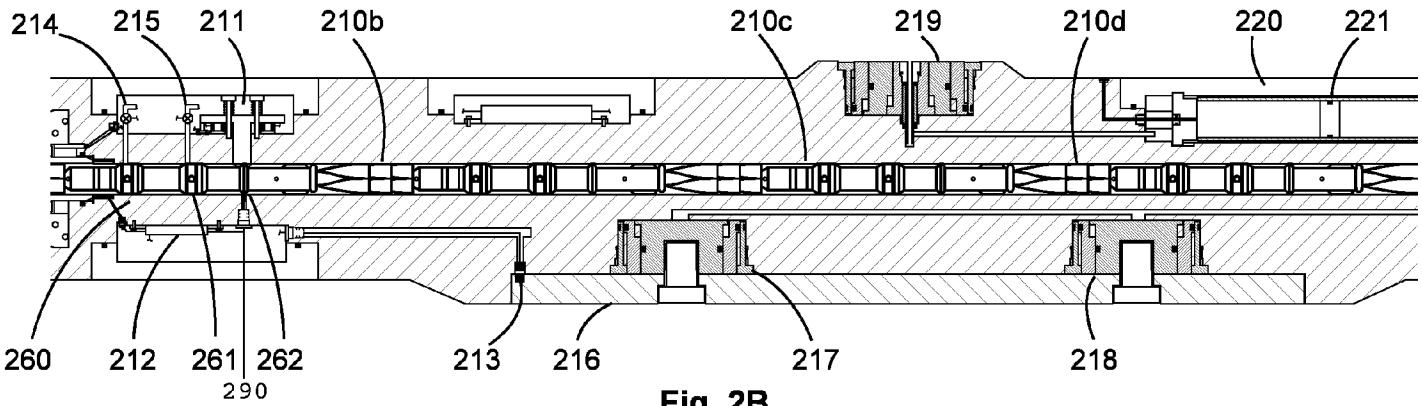
Figure 2C:
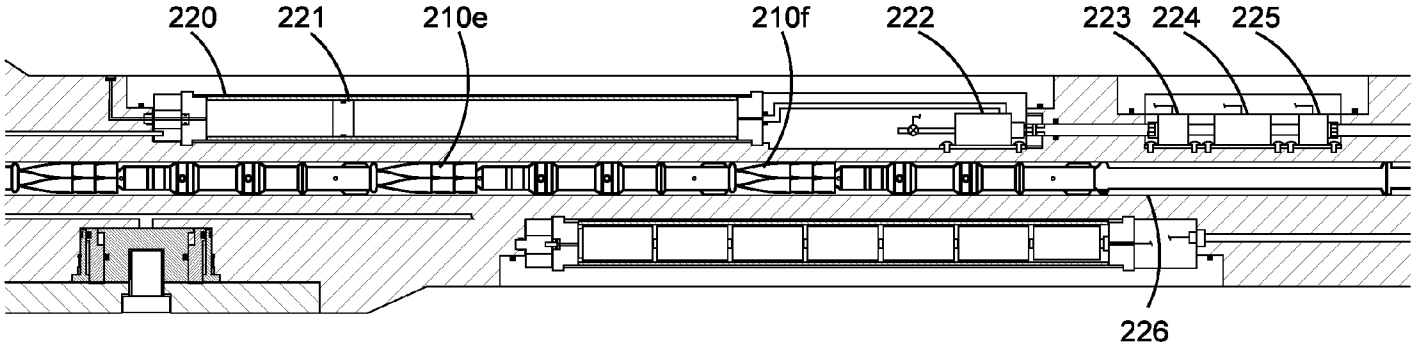
Figure 2D:
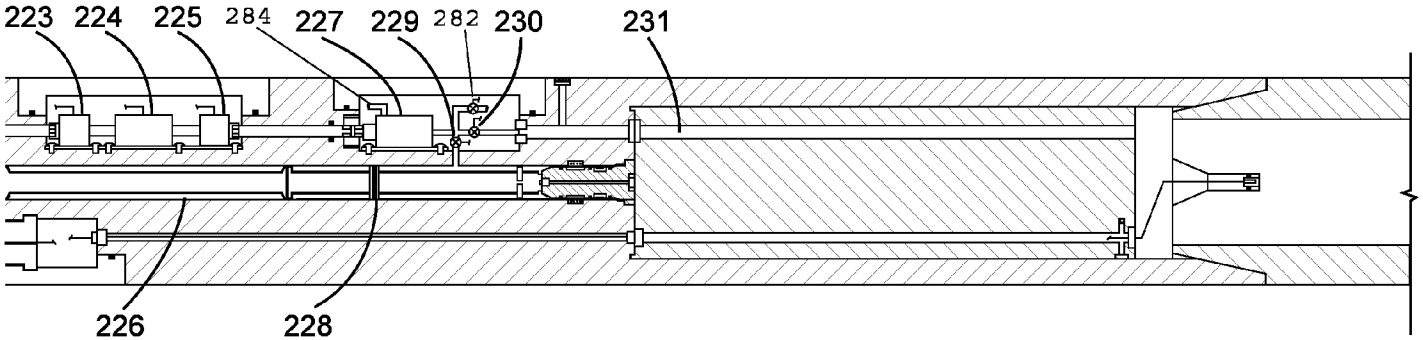

FIG. 1 shows an existing drilling system 100. The drilling system 100 includes a rig 102 mounted at the surface 122, positioned above a borehole 104 within a subterranean formation 106. The rig 102 may be connected to multiple drilling pipes 118 and 120 via a top drive 126 and fluid sample capture tool 128, as will be described below. The drilling system 100 may include a pipe-in-pipe drilling system where an inner pipe 120 is disposed within the outer pipe 118. Drilling muds, for example, may be pumped into the borehole 104 within the annulus defined by the inner pipe 120 within the outer pipe 118. The drilling mud may be pumped downhole through bottom hole assembly (BHA) 108 to the drill bit 110. The BHA 108 may include a fluid sampling tool 114 and other LWD/MWD element 112, which are coupled to the outer pipe 118 and inner pipe 120. In certain embodiments, the drilling fluid may return to the surface 122 within annulus 116, or be diverted into inner pipe 120. A control unit 124 at the surface 122 may control the operation of at least some of the drilling equipment.

In certain embodiments, as will be described below, fluid sampling tool 114 may store sample formation fluids within fluid containers, and deploy the fluid containers to the surface within the inner pipe 120, using the returning drilling fluids. The fluid containers may be captured within the fluid sample capture tool 128 positioned at the surface, and the fluid containers may be retrieved from the fluid sample capture tool 128. In certain embodiments, as will be described below, the fluid sampling tool 114 may include a cache of fluid containers, with each of the fluid containers being individually deployable to the surface. In certain embodiments, as will also be described below, a wireline reloading tool may be used to reload the fluid sampling tool 114 with a cache of new fluid containers once the fluid containers within the fluid sampling tool 114 have been exhausted.

FIGS. 2*a-d* illustrate an example fluid sampling tool 200, according to aspects of the present disclosure. The fluid sampling tool 200 may be included within the BHA of a pipe-in-pipe drilling system, as described above. Although the example fluid sampling tool 200 is shown configured for use in a pipe-in-pipe drilling system, other configurations are possible, as would be appreciated by one of ordinary skill in the art in view of this disclosure. For example the fluid sampling tool 200 may be used in a conventional drilling system which uses a single drilling pipe, where drilling fluid is pumped downhole within the drilling pipe and the drilling fluid returns to the surface within the annulus surrounding the drilling pipe.

Fluid sampling tool 200 includes an elongated tool body 201. The tool body 201 may be sized to couple with the outer pipe 202 of a pipe-in-pipe drilling system. In other embodiments, the tool body 201 may be sized to couple with a drilling pipe in a conventional drilling system. The fluid sampling tool 200 may include inlet port 208 through the tool body 201. The inlet port 208 may be used to direct returning drilling fluid into the inner pipe 203, which is coupled to a flow manifold 204 that is disposed within the tool body 201. The flow manifold 204 may be disposed within the tool body 201 at a top portion of the tool body 201, adjacent to the inlet port 208. The flow manifold 204 may include a float value 205 that includes an inlet port 206, and a spring 207. The flow manifold 204 may be sized to couple with inner pipe 203, and align the inner pipe 203 with a cache of fluid containers 210, disposed within the fluid sampling tool 200, as will be described below.

Figure 3:
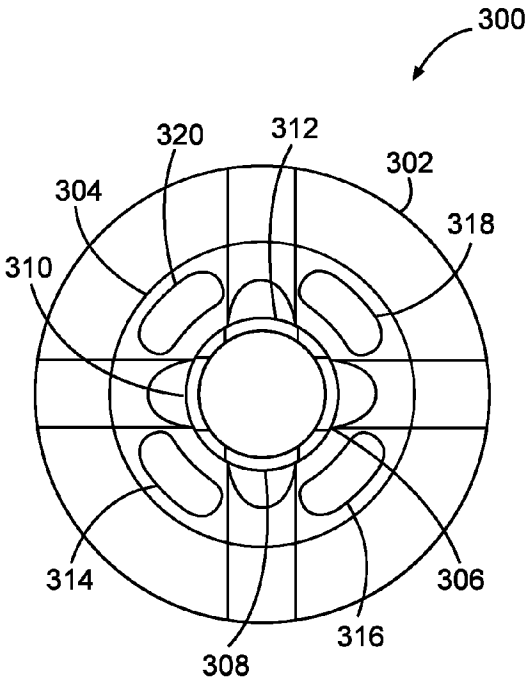
FIG. 3 illustrates a horizontal cross section of an example fluid sampling tool, according to aspects of the present disclosure.

As can be seen in FIG. 3, an example fluid sampling tools incorporating aspects of the present disclosure, such as fluid sampling tool 300, may act as a flow diverter for drilling fluids. For example, as drilling fluid is pumped downhole, the fluid sampling tool 300 may divert the drilling fluid into flow channels 314-320 spanning the length of the fluid sampling tool 300. The size, number, and configuration of the flow channels 314-320 may be altered depending on the application. The flow channels 314-320 may begin in the flow manifold 304 of the fluid sampling tool 300, offset from inlet ports 306-312. As can be seen in FIG. 3, the inlet ports may include appropriately aligned openings in the tool body 302 and flow manifold 304.

Returning to FIGS. 2*a-d*, the downward flow of the drilling fluid may force the float valve 205 downwards within the tool body 201, compressing spring 207. In certain embodiments, the flow manifold 204 and the inlet port 208 of the tool body 201 may be selectively aligned to provide fluid communication between the inner pipe 203 and the outside of the tool body 201. For example, when the float valve 205 is compressed, the inlet port 206 of the float valve 205 may align with the inlet port 208 on the tool body 201 and the port 209 within the flow manifold 204, providing fluid communication between the inner pipe 203 and the outside of the tool body 201.

A cache of fluid containers 263 comprising fluid containers 210*a-f* may be disposed within the fluid sampling tool 200, aligned with the inner pipe 203. The fluid sampling tool 200 may include a releasable latch 211 that secure at least one of the fluid containers within the cache of fluid containers. In the present configuration, the releasable latch 211 secures fluid container 210*a* in a fill position, which may be characterized as the position from which a fluid containers is filled with external fluid and/or gas. The releasable latch 211 may include an engagement face which engages with a ring 262 on the body of the fluid container 210*a*. The releasable latch 211 may include a solenoid which releases the latch when the fluid container 210*a* is to be advanced to a launch position and later launched to the surface. In certain embodiments the releasable latch 211 may sense when the next fluid container 210*b* is in the fill position, triggering the releasable latch 211 to engage the fluid container 210*b*. In other embodiments, a separate proximity sensor 290 may be included. In other embodiments, the releasable latch may be spring loaded, locking the advancing fluid container into the fluid fill position, while at the same time pushing the already filled container into the launch position with the aid of hydraulic pump 227 and piston 226.

In certain embodiments, fluid container fill valves 214 and 215 may be included within the fluid sampling tool 200, in the proximity to the releasable latch 211. The fluid container fill valves 214 and 215 may be disposed between a pump 227 and the fluid container 210*a* in the fill position, and may provide fluid communication between the pump 227 and the fluid container 210*a* when the valves are open. As will be described below, the pump 227 may draw in formation fluid from an extendable snorkel 219. The formation fluid may then be pumped into the fluid container 210*a* through valves 260 and 261 in the fluid container 210*a*, where a formation fluid sample is formed. The fluid container 210*a* and the formation fluid sample may then be shifted to the launch position. The shifting may be achieved by switching the flow of an intake fluid going to the container 210*a* through the piston advancement valve 229 which then applies hydraulic pressure on piston 228. A latch solenoid may then be activated to disengage the latch which releases the cache of containers and allows the containers to advance to the next container fill position.

In certain embodiments, o-rings on the fluid container 210*a* may seal against the fill sampling tool above the fill valve 214 and below the fill valve 215, creating a sealed zone proximate valves 260 and 261 in the fluid container 210*a*. The sealed zone may be filled, for example, with formation fluid as part of the filling process. The formation fluid may be cycled through the valves 260 and 261 in the fluid container 201 via the sealed zone. Advantageously, using the sealed zone to fill the fluid container 210*a* does not require that the valves 260 and 261 be rotationally aligned with the fill valves 214 and 215.

In certain embodiments, as will be described with respect to FIG. 6, the fluid containers 210*a-f* within the cache of fluid containers may include control modules. The control modules may include, for example volatile or non-volatile memory elements disposed within the fluid containers and processors coupled to the memory elements. The tool body 201 may include a coupling device, torroid or induction coil 264, coupled to a controller 212 that can be used to transmit power and/or downhole measurement data to the control module. Advantageously, by storing downhole measurement data within the fluid container, the measurement data may be retrieved at the surface by similar a coupling means or via an electrical connector/cable (not shown) connected to a surface computer. This configuration may be useful when wireline communication of measurement data is impractical. The fluid container 210*a* may also contain sensors for analyzing the sample gas/fluid in the container and store the results of the analysis in the memory of the container as well as the memory of the tool 200 for later retrieval. Such analysis can be done once or frequently over time to track changes in the fluid to chemical reactants, for example, that may be mixed in with the sample to determine various properties or features of the sample.

In certain embodiments, the fluid sampling tool may also include a drillstring torroid or coil 280 for bi-directional communication using the pipe of the drilling system. The torroid 280 may be used to transmit communication signals, such as telemetry data, through the drill string. The signals may be transmitted through the drill string via inductive coupling and be received at the surface via a drill string torroid of coil, as will be described below. In the embodiment shown, the inner pipe may be electrically insulated from the outer pipe except for an area below the torroid or coil 280. At the surface, the inner pipe may be insulated from the outer pipe except for an area above the drilling string torroid, so that electrical signals can be effectively The fluid sampling tool 200 may also include an extendable support pad 216 and an extendable snorkel 219. When a formation fluid sample is to be taken, the support pad 216 and snorkel 219 may be hydraulically extended using hydraulic pump 222 and pistons 217 and 218, to engage with a borehole wall. A sensor 213 may indicate when the support pad 216 is extended or retracted. In certain embodiments, the pump 222 may be driven by an electric motor 224 coupled to the pump 222 through a releasable clutch/brake assembly 223. When engaged the pump 222 may draw hydraulic fluid in through the hydraulic fluid reservoir 220, filling the remaining space above piston 221 with formation fluid, to preserve pressure. Once the support pad 216 and snorkel 219 are fully extended, a valve may be closed, locking the support pad 216 and snorkel 219 in place.

Figure 4:
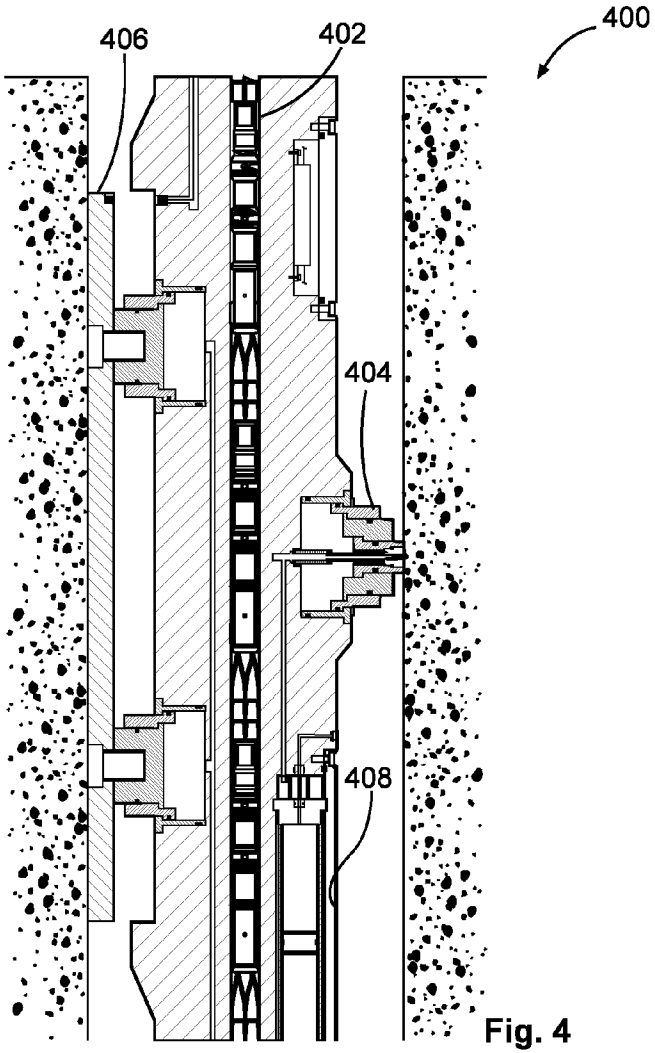
FIG. 4 illustrates a portion of an example fluid sampling tool, according to aspects of the present disclosure.

FIG. 4 illustrates an example fluid sampling tool 400 containing a cache of fluid containers 402. As can be seen the support pad 406 and snorkel 404 are in an extended position, contacting the borehole wall. The support pad 406 and snorkel 404 may be extended using hydraulic fluid from reservoir 408. When the support pad 406 is extended, formation fluid may be drawn into the tool 400. In certain embodiment, the formation fluid may be circulated for a pre-determined period of time to ensure that formation fluid is being captured instead of drilling fluid for example Returning to FIGS. 2*a-d*, once the support pad 216 and snorkel 219 are extended and locked into place, the clutch/brake 223 may be disengaged (braked), and clutch 225 engaged, providing power from motor 224 to pump 227. Pump 227 may draw formation fluid from the snorkel 219 through line 284, and pump the formation fluid into the fluid container 201*a* in the fill position. For example, the pump 227 may be in fluid communication with the fluid container 201*a* in the fill position via valve 282 and valve 215. The valve 214 may be used to cycle pumped fluids through the fluid container 210*a* and into the annulus surrounding the tool. In certain embodiments, the pump 227 may pump the formation fluids into a fluid identification system (not shown) through valve 230, to determine that the fluid drawn in through the snorkel 219 is formation fluid instead of drilling fluid. The fluid identification system may be integral to tool 200 or may be connected to the tool through a fluid communication channel 231 allowing also for other fluid storage and analysis tools to be fluidly connected to the sampling tool. Fluid may be dumped out of the tool 200 and into the drilling fluid through a port (not shown). Once the fluid identification system determines that the fluid is formation fluid, the fluid is directed to the fluid container 210*a* in the fill position to flush the fluid container. Alternately sensors in the container 210*a* may also sense the fluid being circulated through the container and provide control feed back to the sampling process. Controller 212 may control the opening and closing of valves 229 and 230 within the fluid sampling tool to direct the formation fluid to the correct destination. In certain embodiments, the formation fluid may be circulated through the fluid container 210*a* for a predetermined period of time to ensure a viable sample. Once a viable sample has been collected the valves 214 and 215 may be closed, preventing further fluid from being directed into the fluid container 210*a*.

Once the sample has been collected, the snorkel 219 and support pad 216 may be retracted, and the fluid container 210*a* may be deployed to the surface. Deploying the fluid container 210*a* to the launch position may include pumping fluid behind seal 228 to urge piston 226 upwards against the fluid containers. In certain embodiments, pump 227 may divert formation fluid or drilling fluid behind the piston 228. Alternately pump 227 can be switched to a hydraulic system or a separate pump used to pump clean hydraulic fluid into the cavity behind the piston. As the pressure increases, the fluid container 210*a* will be forced upwards. At the same time or prior to, releasable latch 211 may be disengaged from the fluid container 210*a*, allowing the fluid container 210 to be forced into the flow manifold 204. The latch 211 may disengage through the aid of a solenoid actuator that lifts the latch 211 up to disengage it from the container 210*a* or the applied force by the hydraulics may apply sufficient forces as to force the latch to disengage. The latch 211 may hold the cache of containers 210 in position, which also prevents the cache from sliding up or down during drilling operations. Further, if the advancement piston should fail, an overshot can be run in to latch onto the top most container and pull it upwards. This action may pull all the cache 210 upwards towards the fill position for the next container. When the top container 210*a* reaches the launch position, a lower container latch, described below, releases from the cache allowing the next sample container in the cache to remain in place for filling while the filled container can be retrieved to surface with the overshot, which is typically on a wireline cable FIG. 5 illustrates the launch process of one fluid container 502 from a cache of fluid containers within fluid sampling tool 500. Fluid container 502 may include a container body 502*a*, a collapsible flow restrictor 502*b*, and a lower container latch, overshot latch 502*c*. The fluid container 502 may be urged into the flow manifold of the fluid sampling tool, adjacent to the float valve 564. In certain embodiments, pumping drilling fluid downhole may be ceased at this point, ensuring that the float valve 564 is not depressed, and the ports 508 and 506 are not aligned. Once the fluid container 502 escapes the cache, the collapsible flow restrictor 502*b* may expand, contacting the wall of the flow manifold, and an overshot latch 502*b* position at the bottom of the fluid container may also expand, providing lateral stability for the fluid container when it is deployed to the surface and releasing itself from the mechanical coupling of the cache string. Once the fluid container 502 is outside of the cache, drilling mud may be again pumped downhole, compressing the float valve 564. Once compressed, the ports 506 and 508 may align, providing fluid communication between the inner pipe and the outside of the tool body. Returning drilling fluid may be diverted into the inner pipe, creating pressure behind the collapsible flow restrictor 502*b* of the fluid container, and forcing the fluid container to the surface. In certain embodiments, a fluid container may be deployed while the pumps are on.

In an alternative embodiment (not shown) a fluid sampling tool incorporating aspects of the present disclosure may deploy the fluid container to the surface using drilling fluid traveling within the drill string that has yet to reach the drill bit. In such embodiments, a valve of a flow manifold of the fluid sampling tool may divert the drilling fluid from the annulus between the inner and outer pipe into the inner pipe. This embodiment may reduce the risk of cuttings from the borehole contacting the fluid container within the inner pipe as it is deployed to the surface. In certain embodiments, the valve may be triggered using a controller located at the surface or within the fluid sampling tool.

FIG. 6 illustrates an example individually deployable fluid container 600, according to aspects of the present disclosure. The fluid container 600 may include a container body 618. The container body 618 may define a fluid chamber 602. The chamber body 618 may include a fluid sensor 622 such as a fluid identification or fluid properties sensor. The chamber 602 may also contain a chemical reactant 624 to aid in the analysis of the fluid. The container body 618 may also include valves 604, which may be ball valve, for example, and which may provide fluid communication with the chamber 602. Collapsible arms 614 may be coupled to the top of the container body 618, and may be included as part of a collapsible flow restrictor that collapses when the fluid container 600 is within the cache of the fluid sampling tool, but example to contact the wall of an inner pipe of a pipe-in-pipe drilling system once deployed. The collapsible arms 614 may include embedded reinforcement finger strips, typically made of metal, which increase the strength of the collapsible flow restrictor. The fluid container 600 may also include a latch interface 616 which may be used to capture the fluid container 600 at the surface, as will be described below, and may be used to secure the fluid container 600 to other fluid containers within the fluid container cache of the fluid sampling tool. In certain embodiments, where, for example, a conventional drilling system is used, the fluid container 600 may be retrieved to the surface using a wireline tool with an overshot latch that engages with the latch interface 616.

In certain embodiments, the fluid container 600 may also include a control module 612. As discussed previously, the control module 612 may comprise volatile and non-volatile memory elements coupled to a processor. In certain embodiments, sensors may be disposed within the fluid container 600 and controlled by the control module 612. In certain embodiments, the sensors may be used, for example, to identify a resistivity of the formation fluid or a fluid type of the formation fluid. Determining the fluid type may be useful to determine when a sample of formation fluid has been collected within the fluid container, rather than water or drilling mud. The sensor may comprise, for example, optical sensors, electronic sensors, fluid identification sensors, or other sensors well known in the art.

The memory elements may comprise an instruction set that, when executed by the processor, causes the sensors to, for example, measure sample fluid properties, such as resistivity and fluid type, causes the measurement to be stored within the memory elements, or causes the measurements to be transmitted to the surface. Other instruction sets are possible, as would be appreciated by one of ordinary skill in view of this disclosure. The container 600 may also include batteries (not shown) to power the control module. The control module 612 may be electronically connected to a coupling device, torroid or coil inductor 610. The torroid or coil inductor 610 may correspond to a torroid or coil inductor or coupling device within the fluid sampling tool and with a fluid sample capture tool, as will be described below, and may transmit and receive power and data through the torroid or coil inductor 610. The container 600 may also include pressure balance bypass ports 626-630 to prevent hydraulic locking of the container 600.

In certain embodiments, the control module 612 may communicate with the surface. For example, the control module may communicate with the control module in real-time, such that the control module can transfer fluid sample measurements in real-time. In certain embodiments, the control module may include an instruction set to determine whether a proper sample has been taken, or the control module may transmit measurements in real-time to the surface such that surface control systems may determine whether a proper sample has been taken. After the determination, the fluid sample process may be stopped, the container deployed, and the fluid sampling tool moved to a different location within the borehole for sampling. Example fluid containers and control modules may communicate with the surface using, for example, MWD telemetry systems, wired-pipe telemetry systems, etc., that include unidirectional or bi-directional communications. Control commands for the fluid sampling tool may be automated downhole, or sent via the communications pathways from the surface.

In certain embodiments, the fluid container 600 may also include an overshot latch 608 coupled to a spring 606 disposed within the fluid container 600. When deployed within a cache, the overshot latch 608 may be compressed, latching to a fluid container directly behind the fluid container 600 within the cache. Once deployed, the overshot latch 608 may expand, as is shown in FIG. 6, providing lateral stability to the fluid container 600 as it is deployed to the surface and releasing the container's coupling to the container cache, or cache piston if it was the last container in the cache. Retrieving the fluid sample from the fluid container may comprise removing a portion of the fluid container to access the chamber. In one embodiment, the overshot latch 608 may be connected to a removable portion, which threadedly engages with the container body. Accessing the chamber may comprise unscrewing the overshot latch portion and removing the chamber from within the fluid container.

As described above, the fluid container's formation fluid sample may be deployed to the surface. The fluid containers may be deployed to the surface, for example, using wireline tools possessing an overshot latch on its distal end. In such an embodiment, the overshot latch may be landed on top of a fluid sampling tool and latch onto a fluid container in a fill position. A downhole controller may unlatch the container, allowing the wireline tool with the overshot latch to advance the cache of fluid containers. The controller may sense that the fluid container has moved into the launch position and re-engage the latch, securing the next fluid container within the cache in the fill position as the fluid container delatches from the tool and can be pulled to surface.

In certain embodiments, the fluid sampling tool described above may be used within a pipe-in-pipe drilling system. FIGS. 7*a-c* illustrate an example fluid sample capture tool that can be used to capture the fluid containers once they are deployed to the surface. In particular, the fluid sample capture tool 700 may be connected to a top drive mechanism of a drilling system at the surface, and provide access to the captured fluid containers so that the fluid containers can be retrieved and processed at the surface.

The fluid sample capture tool 700 may include an outer pipe 703 and an inner pipe 702 disposed within the outer pipe 703. The outer pipe 703 may be sized to couple with a top drive mechanism 750 and the outer pipe 752 of a pipe-in-pipe drilling system. The inner pipe 702 may be sized to couple with the inner pipe 754 of a pipe-in-pipe drilling system. A removable fluid container capture assembly may be disposed within the inner pipe 702. In certain embodiments, the removable fluid container capture assembly may comprise an overshot latch 704 coupled to the spring 701. The overshot latch 704 may engage with the latch interface on a fluid container 707 once the fluid container is deployed to the surface. The spring 701 may act as a shock absorber for the fluid container 707, so that the upward force on the fluid container 707 during the deployment process can be dissipated upon capture.

The removable fluid container capture assembly may be secured within the inner 702 pipe with a removable sealing cap 710. The removable sealing cap 710 may seal a top end of the inner pipe 702 when installed, and engage with the inner pipe 702 through a threaded engagement. Once the fluid container 707 has been captured, the fluid container 707 may be retrieved from the fluid sample capture tool 700, for example, by disconnecting the top drive 750 from the fluid sample capture tool 700, and the removing the sealing cap 710. The fluid container capture assembly may then be removed along with the fluid container 707.

The fluid sample capture tool 700 may include a flow port 706 in fluid communication with the inner pipe 702. The flow port 706 may comprise ports aligned in the inner pipe 702, the outer pipe 703, a flow mandrel 756, and a housing 758. The flow port 706 may divert drilling fluid from the borehole into a mud pit, where the drilling fluids may be processed and recirculated through the borehole.

Drilling fluid may be pumped downhole from the top drive 750, through the fluid sample capture tool 700 within the annular space 713 within the outer pipe 703. The drilling fluid may be diverted around the flow port 706 via a flow mandrel 756 disposed around the outer pipe 703. In particular, the flow mandrel 756 may include a fluid channel 705 in fluid communication with the annulus 713 via a port 709 in the outer pipe 703. Drilling fluid may flow through port 709, into fluid channel 705, and return to the annular space within the outer pipe 703 through port 708.

In certain embodiments, the fluid sample capture tool 700 may include at least one electronic coupling, torroid or induction coil 714, corresponding to an electronic coupling within the fluid container 707. The fluid sample capture tool may also include a proximity sensor which indicates that a fluid container has arrived at the fluid sample capture tool. In certain embodiments, the fluid container may contain a magnet and the proximity tool may sense the magnet when the fluid container arrives at the fluid sample capture tool. The torroid or induction coil 714 may receive downhole measurement data from the fluid container 707 and/or fluid measurement data from sensors within the fluid container 707 once the fluid container 707 is captured within overshot latch 704. In certain embodiments, the torroid or induction coil 714 may also be used as a proximity sensor to alert rig operators that the fluid container 707 has arrived. In particular, the torroid or induction coil 714 may be coupled to a control system through electrical connection 760. At least one rotary electrical interface 711 and 712, such as slip rings or inductive couplings, may be electrically connected to the torroid or induction coil 714 and provide a communication and/or power pathway between the electrical connection 760 and the torroid or induction coil 714. In drilling configurations where the outer pipe 703 and inner pipe 702 rotate during drilling operation, the electrical interface 711 and 712 may ensure electrical connectivity despite the rotation of the pipes. The fluid sample capture tool 700 may further include a drillstring torroid 782, similar to the drillstring torroid described above, that may be used to transmit signals along the drill string.

In certain embodiments, the cache of fluid containers within the fluid sampling tool may be reloadable. FIG. 8 illustrates an example fluid container reloading tool 800 according to aspects of the present disclosure. The fluid container reloading tool 800 may comprise an elongated cylindrical body connected at the top to a wireline tool and open at the bottom. The opening at the bottom of the body (as will be shown below) may be sized to engage with a fluid sampling tool, such as fluid sampling 200 described above, and may be used to transfer a cache of empty fluid containers 818 disposed within the fluid container reloading tool 800 to the fluid sampling tool. In certain embodiments, the fluid containers 818 may be pre-treated with reactants.

As can be seen in FIG. 8, the fluid container reloading tool 800 may be disposed within an inner pipe 804 of a pipe-in-pipe drilling system comprising the inner pipe 804 and the outer pipe 802. The fluid container reloading tool 800 may include a pump 812 in fluid communication with a piston 810. The piston 810 may be connected to a fluid container in a cache of fluid containers 818 via a shear pin 899. The fluid container reloading tool may also comprise an anchoring mechanism, such as a mechanical latch, wire hangar, latch housing, inflatable packer, or another anchoring mechanism that would be appreciated by one of ordinary skill in the art in view of this disclosure. In the present embodiment, the anchoring mechanism comprises an inflatable packer 806. The pump 812 may be in fluid communication with the inflatable packer 806 disposed on an outer surface on the fluid container reloading tool 800 via a valve 814. When inflated, the inflatable packer 806 may secure the fluid container reloading tool 800 with a drilling pipe such as the inner pipe if present or the outer pipe if not present. The packer may also aid in the centralization of the assembly. The fluid container reloading tool 800 may also include at least one centralizer 808 on the outer surface of the fluid container reloading tool 800 to ease the insertion of the fluid container reloading tool 800 into the borehole and further aid in the engaging alignment with the fluid sampling tool.

Once deployed downhole and engaged with a fluid sampling tool, as will be described below, the inflatable packer 806 may be inflated by opening valve 814 to secure the fluid container reloading tool 800 in position. The pump 812, which may be powered by an electric motor or from power delivered over the wireline, may draw in hydraulic fluid from a reservoir within the tool 800 (not shown) or draw in drilling fluid through the valve 816. The fluid may then be directed to the inflatable packer 806 until a predetermined fluid pressure is generated within the packer, causing the valve 814 to close and prevent the fluid from escaping the inflatable packer 806. Control of valves 814 and 816 may be connected via conductors in the wireline to the surface, where an operator switches the values on or off as required. Alternately a downhole controller may actuate the valves based, for example, on time, a lack of sensed movement, or a proximity sensor identifying that the reloading tool has arrived at a position proximate to the fluid sampling tool. Once the packer is secured, valve 814 may be shut off, locking the packer in an energized state and holding the reloading tool in position. The pump may then continue to build pressure in the cavity between the piston 810 and the pump outlet until the spring ball detent 898 is compressed and the piston 810 is allowed to move away from the pump, pushing the cache of fluid containers into the fluid sampling tool. Eventually the top-most container of the cache of fluid containers may be aligned with the fill position in the fluid sampling tool. At this point the force across the shear pin 899 may increase until the piston 810 shears its connection to the overshot of the top-most container of the cache of fluid containers. A pressure sensor or timer may determine that the insertion process is complete, and valve 814 may be opened and the pump optionally reversed to pull the piston clear of the over shot. Opening the valve 814 may allow the pump to draw fluid from the inflatable packer. At this point the insertion tool may be pulled back out of the hole leaving the new cache of containers in the tool. This process can be repeated as many times as desired throughout the run.

FIGS. 9*a* and 9*b* illustrate an example fluid container reloading tool 900 engaged with a fluid sampling tool 904, similar to the fluid sampling tools described above. As can be seen, the fluid container reloading tool 900 has a bottom opening 906 sized to engage with the fluid sampling tool 904. The bottom opening 906 is aligned with a flow manifold 908 of the fluid sampling tool 904 such that the cache of fluid containers 902 disposed within the fluid container reloading tool 900 can be transferred to the fluid sampling tool 904 through the opening 906. The fluid container reloading tool 900 may be deployed downhole, for example, when the fluid sampling tool has exhausted its supply of fluid containers, as can be seen in FIG. 9*a*.

The fluid container reloading tool 900 may include a pump and piston 914 assembly similar to the assembly described above with respect to FIG. 8, with the cache of fluid containers 902 connected to the piston 914. As the pump forces the piston downwards, the cache of fluid containers 902 may contact a piston 910 disposed within the fluid sampling tool 904. The piston 910 may include a seal assembly 914 similar to that described above with respects to fluid sampling tool 200. As the cache of fluid containers 902 is transferred into the fluid sampling tool 904, the piston 910 may be forced downwards to accommodate each of the fluid containers in the cache of fluid containers.

Once the cache 902 from the reloader tool 900 has been fully transferred, as can be seen in FIG. 9*b*, the piston 914 may contact a shoulder at the bottom opening 906 of the reloader tool 900. Once the piston 914 contacts the shoulder, the pressure behind the piston may spike, causing a shear pin within the piston to break, releasing the connection between the cache of fluid containers 902 and the piston 914. Additionally, the pressure spike may trigger a releasable latch 912 disposed within the fluid sampling tool 904 to engage with at least one of the fluid containers of the cache of fluid containers 902 so that the cache is secured within the fluid sampling tool 900. In certain embodiments, a controller in the fluid sampling tool may be commanded from the surface to go into reload mode, causing a latch to retract and allow the new cache of fluid containers to be inserted. In certain embodiments, the controller may use proximity sensors within the fluid sampling tool to count the number of containers that have passed by, and once the last container is in position re-engage the latch. The proximity sensor may be of several types but one example is a small magnet ring on the fluid container and cache piston that can be used to identify specific locations with a Hall effect sensor. Once the cache has been fully transferred, the inflatable packer may be deflated and the reloader tool 900 may be retrieved to the surface. The reloader tool 900 may be used in a conventional or pipe-in-pipe drilling assembly. Advantageously, the reloader tool 900 may allow decrease the cost and time required for fluid sampling by allowing a fluid sampling tool to be reloaded multiple times without having to be retrieved to the surface.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that it introduces.

What is claimed is:

1. A method, comprising:

positioning a fluid container within a borehole in a subterranean formation;

securing the fluid container in a fill position via a releasable latch;

pumping a fluid sample into the fluid container through a valve disposed between the fluid container and a pump;

storing in the fluid container, measurement data from within the borehole;

shifting the fluid container to a launch position;

deploying the fluid container to the surface through a drill string at least partially positioned within the borehole; and retrieving the stored measurement data from the fluid container.

2. The method of claim 1, wherein storing in the fluid container, measurement data from within the borehole comprises storing measurement data from one or more sensors within a bottom hole assembly (BHA) coupled to the drill string.

3. The method of claim 2, wherein positioning the fluid container within the borehole comprises positioning the fluid container within the BHA.

4. The method of claim 2, wherein storing measurement data from the one or more sensors within the BHA comprises selecting a type of measurement data to be stored within the fluid container.

5. The method of claim 1, wherein deploying the fluid container to the surface through the drill string comprises deploying the fluid container to the surface through the drill string without introducing a fluid sample into the fluid container.

6. The method of claim 1, wherein the measurement data comprises at least one of a fluid type, a viscosity, a density, and a temperature of a fluid sample within the fluid container.

7. The method of claim 1, wherein retrieving the stored measurement data from the fluid container comprises retrieving the stored measurement data from the fluid container comprises through a coupling device positioned at the surface.

8. The method of claim 7, wherein the coupling device comprises at least one of a torroid and an induction coil.

9. The method of claim 7, wherein retrieving the stored measurement data from the fluid container comprises retrieving the stored measurement data from the fluid container while the fluid container is in fluid communication with an inner bore of the drill string.

* * * * *